US009822646B2

(12) United States Patent
Liang et al.

(10) Patent No.: US 9,822,646 B2
(45) Date of Patent: Nov. 21, 2017

(54) TURBINE AIRFOIL COOLING SYSTEM WITH SPANWISE EXTENDING FINS

(71) Applicant: Siemens Aktiengesellschaft, München (DE)

(72) Inventors: George Liang, Palm City, FL (US); Nan Jiang, Charlotte, NC (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

(21) Appl. No.: 15/318,038

(22) PCT Filed: Jul. 24, 2014

(86) PCT No.: PCT/US2014/047934
§ 371 (c)(1),
(2) Date: Dec. 12, 2016

(87) PCT Pub. No.: WO2016/014056
PCT Pub. Date: Jan. 28, 2016

(65) Prior Publication Data

US 2017/0130598 A1 May 11, 2017

(51) Int. Cl.
*F01D 5/18* (2006.01)
*F01D 9/06* (2006.01)
*F01D 9/04* (2006.01)

(52) U.S. Cl.
CPC ..... *F01D 5/18* (2013.01); *F01D 9/041* (2013.01); *F01D 9/065* (2013.01); *F05D 2260/22141* (2013.01)

(58) Field of Classification Search
CPC ..... F01D 5/18; F01D 9/065
See application file for complete search history.

(56) References Cited

U.S. PATENT DOCUMENTS 2,843,354 A 7/1958 Smith
5,626,462 A * 5/1997 Jackson ..... C22C 32/00 416/229 A (Continued)

FOREIGN PATENT DOCUMENTS

EP 1621730 A1 1/2006
EP 1947295 A1 7/2008
EP 2586981 A2 1/2013

OTHER PUBLICATIONS

PCT International Search Report and Written Opinion dated Dec. 11, 2014 corresponding to PCT Application PCT/US2014/047934 filed Jul. 24, 2014. (11 pages).

*Primary Examiner* — Justin Seabe
*Assistant Examiner* — Juan G Flores

(57) ABSTRACT

A cooling system for a turbine airfoil of a gas turbine engine is disclosed, whereby the cooling system includes spanwise extending midflow blockers positioned within one or more cooling channels to maintain an internal through flow channel Mach number. One or more cooling channels may have a larger cross-sectional area proximate to an outer end of the airfoil than at an inner end. One or more cooling channels include midflow blockers extending into the cooling channel. In at least one embodiment, the midflow blocker may extend radially inward from the outer end of the airfoil. The midflow blocker may limit movement of cooling fluid from the pressure side to the suction side or vice versa. The midflow blocker may increase in size moving radially outward as the cross-sectional area of the cooling channel increases as well. Such configuration keeps the internal through flow channel Mach number within design limits.

14 Claims, 4 Drawing Sheets

(56) References Cited

U.S. PATENT DOCUMENTS

| | | | | |
|---|---|---|---|---|
| 5,660,524 | A | 8/1997 | Lee et al. | |
| 5,813,836 | A | 9/1998 | Starkweather | |
| 6,206,638 | B1 | 3/2001 | Glynn et al. | |
| 6,241,466 | B1 | 6/2001 | Tung et al. | |
| 6,607,356 | B2 | 8/2003 | Manning et al. | |
| 7,413,407 | B2 | 8/2008 | Liang | |
| 7,435,053 | B2 | 10/2008 | Liang | |
| 7,527,474 | B1 | 5/2009 | Liang | |
| 7,918,647 | B1 | 4/2011 | Liang | |
| 7,967,567 | B2 * | 6/2011 | Liang | F01D 5/186 415/115 |
| 8,016,563 | B1 | 9/2011 | Liang | |
| 8,070,441 | B1 | 12/2011 | Liang | |
| 8,177,507 | B2 | 5/2012 | Pietraszkiewicz et al. | |
| 8,257,035 | B2 | 9/2012 | Schilp | |
| 8,523,523 | B2 * | 9/2013 | Townes | F01D 5/187 416/90 R |
| 2007/0231138 | A1 | 10/2007 | Levine et al. | |
| 2011/0038735 | A1 | 2/2011 | Liang et al. | |
| 2012/0063908 | A1 | 3/2012 | Islam et al. | |
| 2012/0177503 | A1 | 7/2012 | Lee et al. | |
| 2013/0302179 | A1 | 11/2013 | Bergholz, Jr. et al. | |

* cited by examiner

TURBINE AIRFOIL COOLING SYSTEM WITH SPANWISE EXTENDING FINS

FIELD OF THE INVENTION

This invention is directed generally to turbine airfoils, and more particularly to cooling systems in hollow turbine airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,260 degrees Fahrenheit. Typical turbine combustor configurations expose turbine vane assemblies to these high temperatures. As a result, turbine vanes must be made of materials capable of withstanding such high temperatures. In addition, turbine vanes often contain cooling systems for prolonging the life of the vanes and reducing the likelihood of failure as a result of excessive temperatures.

Typically, turbine vanes are formed from an airfoil having an inner diameter (ID) platform at an inboard end and having an outer diameter (OD) platform at the outboard end. The vane is ordinarily includes a leading edge and a trailing edge with inner aspects of most turbine vanes typically containing an intricate maze of cooling channels forming a cooling system. The cooling channels in a vane typically receive air from the compressor of the turbine engine and pass the air through the vane. The cooling channels often include multiple flow paths that are designed to maintain all aspects of the turbine vane at a relatively uniform temperature. Providing adequate cooling to turbine vanes having large cross-sectional flow areas at the ID and OD has been challenging.

SUMMARY OF THE INVENTION

A cooling system for a turbine airfoil of a gas turbine engine is disclosed, whereby the cooling system includes spanwise extending midflow blockers positioned within one or more cooling channels to maintain an internal through flow channel Mach number. One or more cooling channels may have a larger cross-sectional area proximate to an outer end of the airfoil than at an inner end. One or more cooling channels may include midflow blockers extending into the cooling channel. In at least one embodiment, the midflow blocker may extend radially inward from the outer end of the airfoil. The midflow blocker may limit movement of cooling fluid from the pressure side to the suction side or vice versa. The midflow blocker may increase in size moving radially outward as the cross-sectional area of the cooling channel increases as well. Such configuration keeps the internal through flow channel Mach number within design limits.

In at least one embodiment, the turbine airfoil may include a generally elongated hollow airfoil formed from an outer wall, and having a leading edge, a trailing edge, a pressure side, a suction side, a first end of the airfoil and a second end opposite to the first end, and a cooling system positioned within interior aspects of the generally elongated hollow airfoil. One or more cooling channels of the cooling system may have a larger cross-sectional area proximate to an outer diameter end of the airfoil than at an inner diameter end of the airfoil. One or more midflow blockers may extend from a first end at an inner surface forming the at least one cooling channel toward a second end positioned closer to a midpoint of the cooling channel in a spanwise extending direction and extending from a base at the inner surface to a tip positioned closer to a centerline axis of the at least one cooling channel. The midflow blocker may tapes from the first end having a larger cross-sectional area to the second end having a smaller cross-sectional area positioned closer to the midpoint of the cooling channel. The base of the midflow blocker may be in contact with the inner surface forming the cooling channel from a first end of the midflow blocker to a second end of the midflow blocker. The midflow blocker may also be tapered from the base of the midflow blocker to the tip. A cross-sectional area of the midflow blocker within 25 percent of a length from the base to the tip from the base may be larger than a cross-sectional area of the midflow blocker within 25 percent of a length from the base to the tip from the tip. In at least one embodiment, the midflow blocker may have a rounded tip.

The midflow blocker may include two midflow blockers, wherein a first midflow blocker may extend from a first side of the at least one cooling channel and a second midflow blocker may extend from a second side of the at least one cooling channel. The first side of the cooling channel is generally on an opposite side of the cooling channel from the second side of the cooling channel. The first side of the cooling channel may extend from the outer wall forming the pressure side to the outer wall forming the suction side. The second side of the cooling channel may extend from the outer wall forming the pressure side to the outer wall forming the suction side. The first end of the midflow blocker may be positioned at an outer diameter platform.

The cooling channel of the cooling system may include a leading edge cooling channel with an inlet at an outer diameter platform and an outlet at an inner diameter platform. The cooling channel of the cooling system may include a mid-chord serpentine cooling channel extending from the outer diameter platform to the inner diameter platform with chordwise extending cooling channel legs. The plurality of trip strips may extend from the outer wall forming the pressure side into the cooling channel and a plurality of trip strips may extend from the outer wall forming the suction side into the least one cooling channel. The cooling channel may be formed from a plurality of cooling channels forming a spanwise extending serpentine cooling channel, wherein at least one inboard flowing cooling channel may include at least one midflow blocker and wherein at least one outboard flowing cooling channel includes at least one midflow blocker. A leading edge inboard flowing cooling channel may include one or more midflow blockers and at least two inboard flowing cooling channels and at least two outboard flowing cooling channels may include at least one midflow blocker.

During use, cooling fluids may flow into the cooling system from a cooling fluid supply source through the inlet of the leading edge cooling channel. As the cooling fluids flow into the leading edge cooling channel, the fluids encounter a midflow blocker that causes the velocity of the cooling fluids to increase because the midflow blocker reduces the cross-sectional area of the leading edge cooling channel. The velocity of the fluid flowing through the first leg is at or above a design internal through flow channel Mach number. The cooling fluids also encounter the trip strips, which increase the amount of heat transfer. The cooling fluids may flow through the leading edge cooling channel and may be exhausted through the first turn into the second leg. As the cooling fluids flow radially outward in the second leg, the cross-sectional area of the turbine airfoil expands moving radially outward toward the outer end.

However, the midflow blockers increase in size moving radially outward to maintain the design internal through flow channel Mach number. The midflow blockers may essentially turn the second leg from a single open flow channel into two narrow flow channels proximate to the outer end for maintaining the design internal through flow channel Mach number. The cooling fluids may flow radially outwardly through the second leg and may be exhausted through the second turn into the third leg. In the third leg, the cooling fluids flow radially inward through the two narrow flow channels formed by the midflow blockers in the third leg and are joined together radially inward of the midflow blockers in the third leg. The midflow blockers maintain the flow of cooling fluids through the third, fourth and fifth legs. The cooling fluids flow through the third, fourth and fifth legs where the cooling fluids increase in temperature and are exhausted through the trailing edge exhaust orifices.

An advantage of the cooling system is that the cooling system works exceptionally well to cool airfoils with larger outer ends, such as typical in second and third stage airfoils, which have cooling channels with larger cross-sectional areas at outer ends than at the inner ends.

Another advantage of the cooling system is that use of one or more midflow blockers avoids a drastic reduction of channel flow Mach number.

Still another advantage of the cooling system is that by incorporating one or more midflow blockers into the outer portions of the serpentine cooling channels where the serpentine channel flow area becomes too large to maintain the through flow channel Mach number, the diffusion problem for a low mass flux at the outer diameter platform can be eliminated.

Another advantage of the cooling system is that the arrangement of midflow blockers described herein may eliminate the cooling flow mal-distribution commonly found in low mass flux flow channels and instead push the cooling air toward the outer walls of the airfoil wall and boost the flow channel through flow velocity, thereby increasing the channel heat transfer enhancement.

Yet another advantage of the cooling system is that sizing of the midflow blocker may be customized to achieve a constant cooling flow channel cross-sectional area within all or a portion of the cooling channel.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
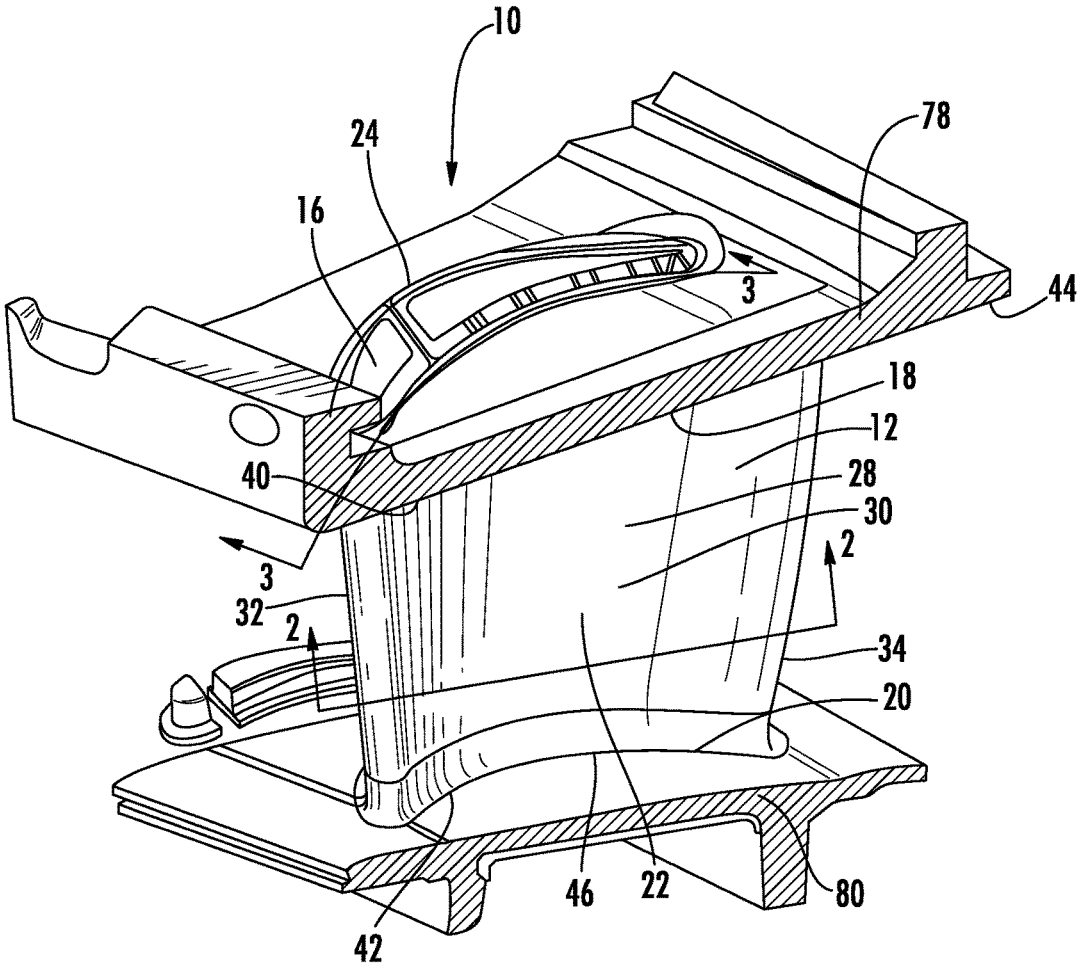
FIG. 1 is a perspective view of an airfoil with the cooling system.

As shown in FIGS. 1-4, a cooling system 10 for a turbine airfoil 12 of a gas turbine engine is disclosed, whereby the cooling system 10 includes spanwise extending midflow blockers 14 positioned within one or more cooling channels 16 to maintain an internal through flow channel Mach number. One or more cooling channels 16 may have a larger cross-sectional area proximate to an outer end 18 of the airfoil 12 than at an inner end 20. One or more cooling channels 16 may include midflow blockers 14 extending into the cooling channel 16. In at least one embodiment, the midflow blocker 14 may extend radially inward from the outer end 18 of the airfoil 12. The midflow blocker 14 may limit movement of cooling fluid from the pressure side 22 to the suction side 24 or vice versa. The midflow blocker 14 may increase in size moving radially outward as the cross-sectional area of the cooling channel 16 increases as well. Such configuration keeps the internal through flow channel Mach number within design limits.

In at least one embodiment, the turbine airfoil 12 may be formed from a generally elongated hollow airfoil 28 formed from an outer wall 30, and having a leading edge 32, a trailing edge 34, a pressure side 22, a suction side 24, a first end 40 of the airfoil 26 and a second end 42 opposite to the first end 40, and a cooling system 10 positioned within interior aspects of the generally elongated hollow airfoil 28. One or more cooling channels 16 of the cooling system 10 may have a larger cross-sectional area proximate to an outer diameter end 44 of the airfoil 12 than at an inner diameter end 46 of the airfoil 12. One or more midflow blockers 14 may extend from a first end 48 at an inner surface 50 forming the cooling channel 16 toward a second end 52 positioned closer to a midpoint 54 of the cooling channel 16 in a spanwise extending direction and extending from a base 56 at the inner surface 50 to a tip 58 positioned closer to a centerline axis 60 of the cooling channel 16. In another embodiment, one or more midflow blockers 14 may extend an entire length of one or more cooling channels 16, such as from the first end 40 of the airfoil 26 to the second end 42. In at least one embodiment, one or more midflow blockers 14 may be formed from the same material used to form the airfoil 12. The midflow blocker 14 may be a separate component or integrally formed with the airfoil 12. In yet another embodiment, the midflow blocker 14 may be formed from a material that is different from a material used to form the airfoil 12, including the generally elongated hollow airfoil 28. The material used to form the midflow blocker 14 may be, but is not limited to being, a lightweight material, such as, but not limited to, titanium-aluminum (TiAl).

Figure 2:
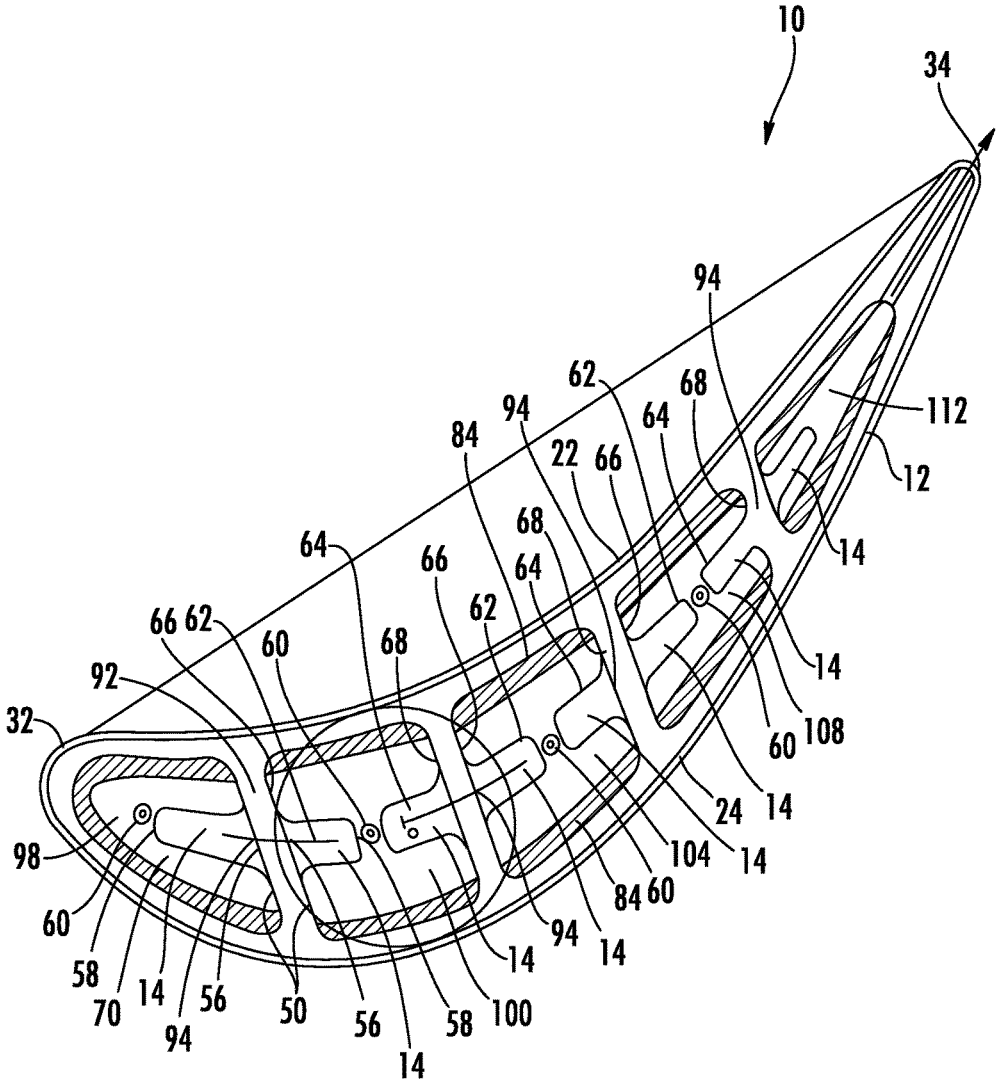
FIG. 2 is a cross-sectional view of the airfoil taken at section line 2-2 in FIG. 1.
Figure 3:
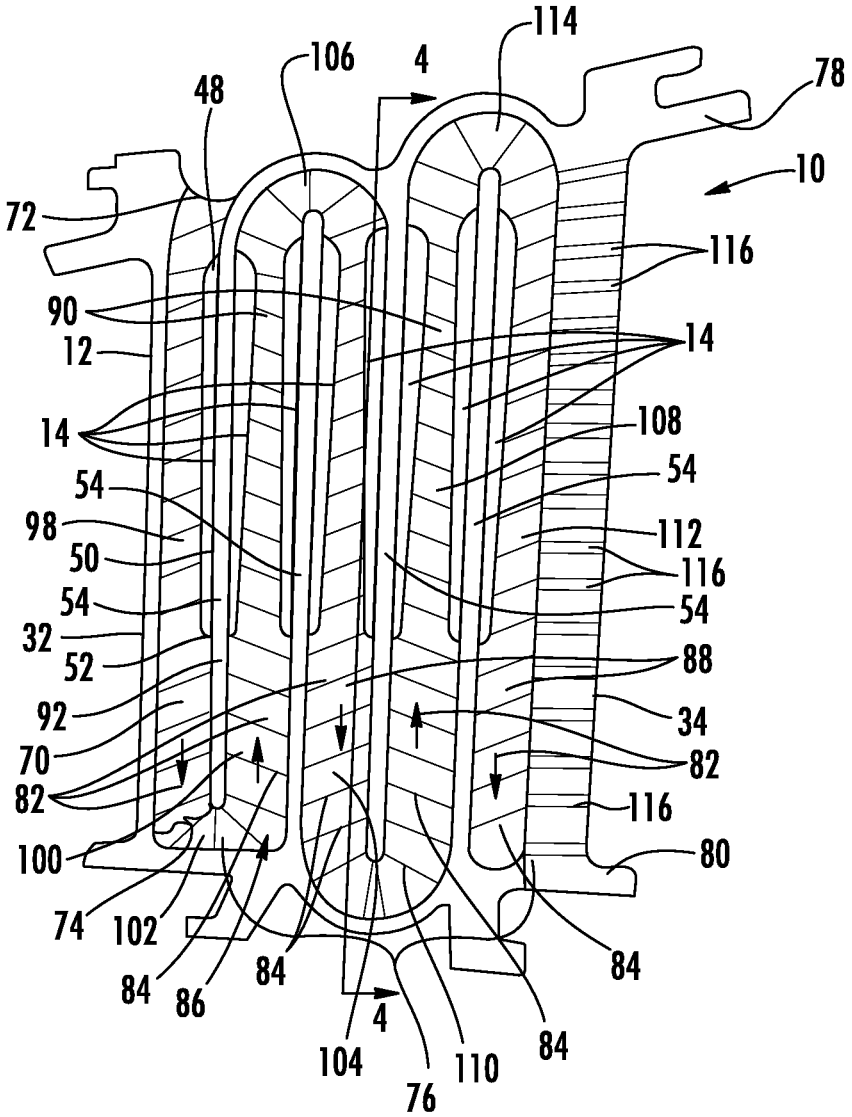
FIG. 3 is a cross-sectional, filleted view of the airfoil taken at section line 3-3 in FIG. 1.
Figure 4:
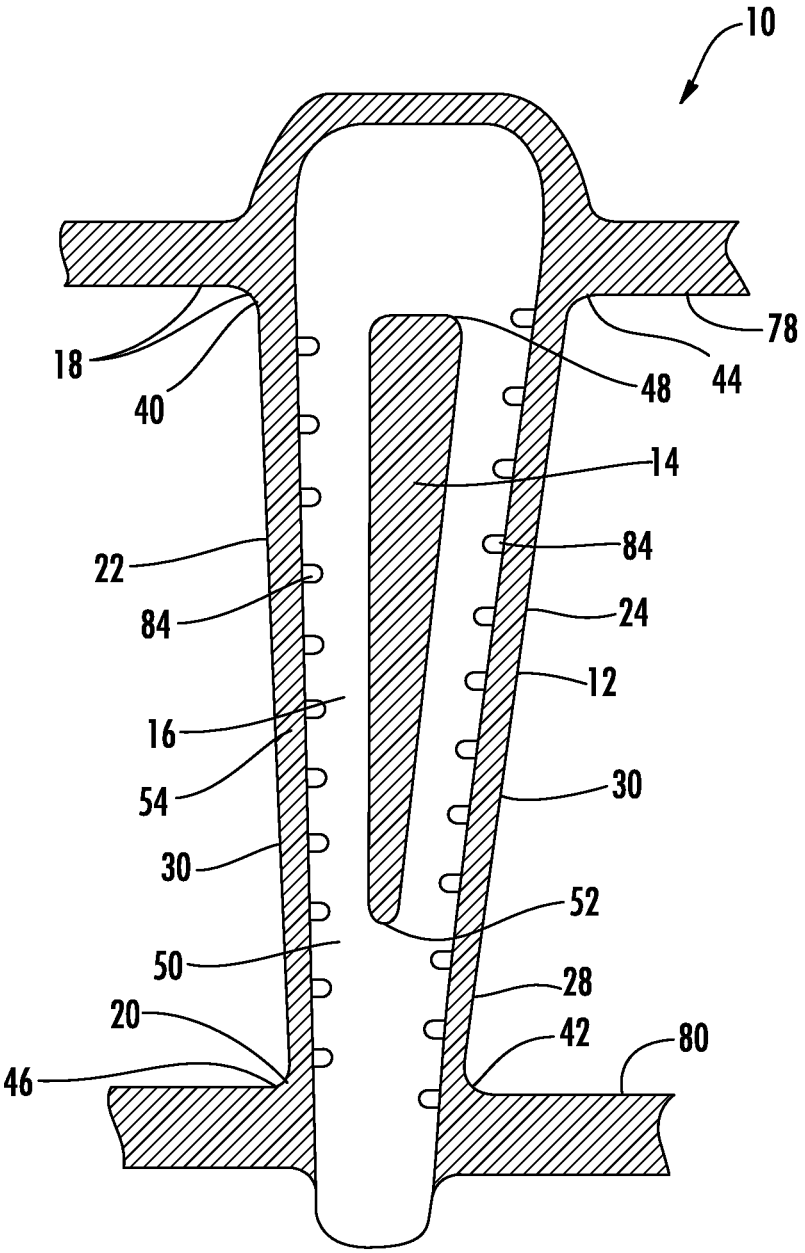
FIG. 4 is a cross-sectional view of the airfoil taken at section line 4-4 in FIG. 3.

In at least one embodiment, as shown in FIG. 4, the midflow blocker 14 may taper from the first end 48 having a larger cross-sectional area to the second end 52 having a smaller cross-sectional area positioned closer to the midpoint 54 of the cooling channel 16. The base 56 of the midflow blocker 14, as shown in FIGS. 2 and 3, may be in contact with the inner surface 50 forming the cooling channel 16 from a first end 48 of the midflow blocker 14 to a second end 42 of the midflow blocker 14. The midflow blocker 12 may also be tapered from the base 56 of the midflow blocker 14 to the tip 58. In at least one embodiment, a cross-sectional area of the midflow blocker 14 within 25 percent of a length from the base 56 to the tip 58 from the base 56 is larger than a cross-sectional area of the midflow blocker 14 within 25 percent of a length from the base 56 to the tip 58 from the tip 58. In at least one embodiment, the midflow blocker 14 may have a rounded tip. One or more cooling channels 16 may include two midflow blockers 14. A first midflow blocker 62 may extend from a first side 66 of the cooling channel 16 and a second midflow blocker 64 may extend from a second side 68 of the cooling channel 16. The first side 66 of the cooling channel 16 may be generally on an opposite side of the cooling channel 16 from the second side 68 of the cooling channel 16. The first side 66 of the cooling channel 16 may extend from the outer wall 30 forming the pressure side 22 to the outer wall 30 forming the suction side 24. The second side 68 of the cooling channel 16 may extend from the outer wall 30 forming the pressure side 22 to the outer wall 30 forming the suction side 24. In another embodiment, a plurality of midflow blockers 62 may extend from the first side 66 or the second side 68, or both. In another embodiment, two or more midflow blockers 62 may extend from the first side 66 while a single midflow blocker 62 extends from the second side 68. In at least one embodiment, the first end 48 of the midflow blocker 14 may be positioned at the outer diameter platform 44.

As shown in FIG. 3, the cooling channel 16 of the cooling system 10 may include a leading edge cooling channel 70 with an inlet 72 at the outer diameter platform 78 and an outlet 74 at the inner diameter platform 80. The cooling channel 16 of the cooling system 10 may include one or more mid-chord serpentine cooling channels 76 extending from the outer diameter platform 78 to the inner diameter platform 80 with chordwise extending cooling channel legs 82. The cooling system 10 may include a plurality of trip strips 84 extending from the outer wall 30 forming the pressure side 22 into the cooling channel 16 and a plurality of trip strips 84 extending from the outer wall 30 forming the suction side 22 into the cooling channel 16. The cooling channel 16 may include one or more cooling channels 16 forming a spanwise extending serpentine cooling channel 86. One or more inboard flowing cooling channels 88 may include at least one midflow blocker 14, and one or more outboard flowing cooling channels 90 may include at least one midflow blocker 14. In at least one embodiment, a leading edge inboard flowing cooling channel 70 may include one or more midflow blockers 14, at least two inboard flowing cooling channels 88 and at least two outboard flowing cooling channels 90 may include one or more midflow blockers 14. The leading edge inboard flowing cooling channel 70 may include one midflow blocker 14 extending from an internal rib 92 towards the leading edge 32. The midflow blocker 14 may include a first end 48 positioned at an outer diameter end 44 of the airfoil 12.

As shown in FIG. 3, the cooling system 10, in at least one embodiment, may include a five pass spanwise extending serpentine cooling channel 86. The five pass spanwise extending serpentine cooling channel 86 may include the leading edge inboard flowing cooling channel 70, two inboard flowing cooling channels 88 and two outboard flowing cooling channels 90. The leading edge inboard flowing cooling channel 70 may include an inlet 96 and may be the first leg 98. An outboard flowing cooling channel 90 may form a second leg 100 and may be in fluid communication with the first leg 98 via a first turn 102. An inboard flowing cooling channel 88 may form a third leg 104 and may be in fluid communication with the second leg 100 via a second turn 106. Another outboard flowing cooling channel 90 may form a fourth leg 108 and may be in fluid communication with the third leg 104 via a third turn 110. The last inboard flowing cooling channel 88 may form a fifth leg 112 and may be in fluid communication with the fourth leg 108 via a fourth turn 114. The fifth leg 112 may be in fluid communication with a plurality of trailing edge exhaust orifices 116 to exhaust cooling fluids from the cooling system 10.

The two inboard flowing cooling channels 88 may each include two midflow blockers 14 extending from internal ribs 92 towards a centerline axis 60 of the inboard flowing cooling channels 88. The two midflow blockers 14 may be positioned on opposite sides of the inboard flowing cooling channel 88 from each other. The two midflow blockers 14 may also be positioned at a midpoint 94 of the inboard flowing cooling channel 88 between the pressure and suction sides 22, 24. The midflow blockers 14 may include a first end 48 positioned at an outer diameter end 44 of the airfoil 12.

The two outboard flowing cooling channels 90 may each include two midflow blockers 14 extending from internal ribs 92 towards the centerline axis 60 of the outboard flowing cooling channels 90. The two midflow blockers 14 may be positioned on opposite sides of the outboard flowing cooling channel 90 from each other. The two midflow blockers 14 may also be positioned at a midpoint 94 of the outboard flowing cooling channel 90 between the pressure and suction sides 22, 24. in other embodiments, the midflow blockers 14 may be offset from the midpoint 94 toward the pressure or suction sides 22, 24. The midflow blockers 14 may aligned along the midpoint 94 within one or more cooling channels 16, may be offset towards the pressure or suction sides 22, 24 equally or offset by different distances or different directions. The midflow blockers 14 may include a first end 48 positioned at an outer diameter end 44 of the airfoil 12.

During use, cooling fluids may flow into the cooling system 10 from a cooling fluid supply source through the inlet 72 of the leading edge cooling channel 70. As the cooling fluids flow into the leading edge cooling channel 70, the fluids encounter a midflow blocker 14 that causes the velocity of the cooling fluids to increase because the midflow blocker 14 reduces the cross-sectional area of the leading edge cooling channel 70. The velocity of the fluid flowing through the first leg 98 is at or above a design internal through flow channel Mach number. The cooling fluids also encounter the trip strips 84, which increase the amount of heat transfer. The cooling fluids may flow through the leading edge cooling channel 70 and may be exhausted through the first turn 102 into the second leg 100. As the cooling fluids flow radially outward in the second leg 100, the cross-sectional area of the turbine airfoil 12 expands moving radially outward toward the outer end 18. However, the midflow blockers 14 increase in size moving radially outward to maintain the design internal through flow channel Mach number. The midflow blockers 14 may essentially turn the second leg 100 from a single open flow channel into two narrow flow channels proximate to the outer end 18 for maintaining the design internal through flow channel Mach number. The cooling fluids may flow radially outwardly through the second leg 100 and may be exhausted through the second turn 106 into the third leg 104. In the third leg 104, the cooling fluids flow radially inward through the two narrow flow channels formed by the midflow blockers 14 in the third leg 104 and are joined together radially inward of the midflow blockers 14 in the third leg 104. The midflow blockers 14 maintain the flow of cooling fluids through the third, fourth and fifth legs 104, 108, 112. The cooling fluids flow through the third, fourth and fifth legs 104, 108, 112 where the cooling fluids increase in temperature and are exhausted through the trailing edge exhaust orifices 116.

In at least one embodiment, the configuration of the cooling system 10 with midflow blockers 14 may be constructed through the use of a print parts manufacturing technique. Because the midflow blockers 14 are not in the same direction parallel to the airfoil internal ribs, it is impossible to produce a ceramic core for this complicated cooling geometry disclosed herein via ceramic core die.

With the print parts manufacturing technique, a ceramic core can be printed and then used to create the airfoil 12 with the cooling system 10 with midflow blockers 14. Alternatively, the airfoil 12 with the cooling system 10 with midflow blockers 14 can be printed from one or more metals.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine airfoil comprising:

a generally elongated hollow airfoil formed from an outer wall, and having a leading edge, a trailing edge, a pressure side, a suction side, a first end of the airfoil and a second end opposite to the first end, and a cooling system positioned within interior aspects of the generally elongated hollow airfoil;

at least one cooling channel of the cooling system having a larger cross-sectional area proximate to an outer diameter end of the airfoil than at an inner diameter end of the airfoil; and at least one midflow blocker extending from a first end at an inner surface forming the at least one cooling channel toward a second end positioned closer to a midpoint of the at least one cooling channel than the first end in a spanwise extending direction and extending from a base at the inner surface to a tip positioned closer to a centerline axis of the at least one cooling channel than the base, wherein the at least one midflow blocker tapers from the first end of the midflow blocker having a larger cross-sectional area to the second end of the midflow blocker having a smaller cross-sectional area positioned closer to the midpoint of the at least one cooling channel.

2. The turbine airfoil of claim 1, wherein the base of the at least one midflow blocker is in contact with the inner surface forming the at least one cooling channel from a first end of the at least one midflow blocker to a second end of the at least one midflow blocker.

3. The turbine airfoil of claim 1, wherein the at least one midflow blocker is tapered from the base of the at least one midflow blocker to the tip.

4. The turbine airfoil of claim 1, wherein a cross-sectional area of the at least one midflow blocker within 25 percent of a length from the base to the tip from the base is larger than a cross-sectional area of the at least one midflow blocker within 25 percent of a length from the base to the tip from the tip.

5. The turbine airfoil of claim 1, wherein the at least one midflow blocker is formed from a material that is different than a material forming the generally elongated hollow airfoil.

6. The turbine airfoil of claim 1, wherein the at least one midflow blocker comprises two midflow blockers, wherein a first midflow blocker extends from a first side of the at least one cooling channel and a second midflow blocker extends from a second side of the at least one cooling channel.

7. The turbine airfoil of claim 1, wherein a first side of the at least one cooling channel is generally on an opposite side of the at least one cooling channel from a second side of the at least one cooling channel.

8. The turbine airfoil of claim 1, wherein a first side of the at least one cooling channel extends from the outer wall forming the pressure side to the outer wall forming the suction side, and wherein a second side of the at least one cooling channel extends from the outer wall forming the pressure side to the outer wall forming the suction side.

9. The turbine airfoil of claim 1, wherein the first end of the at least one midflow blocker is positioned at an outer diameter platform.

10. The turbine airfoil of claim 1, wherein the at least one cooling channel of the cooling system comprises a leading edge cooling channel with an inlet at an outer diameter platform and an outlet at an inner diameter platform.

11. The turbine airfoil of claim 10, wherein the at least one cooling channel of the cooling system comprises a mid-chord serpentine cooling channel extending from the outer diameter platform to the inner diameter platform with chordwise extending cooling channel legs.

12. The turbine airfoil of claim 1, further wherein a plurality of trip strips extending from the outer wall forming the pressure side into the least one cooling channel and a plurality of trip strips extending from the outer wall forming the suction side into the least one cooling channel.

13. The turbine airfoil of claim 1, wherein the at least one cooling channel comprises a plurality of cooling channels forming a spanwise extending serpentine cooling channel, wherein at least one inboard flowing cooling channel includes at least one midflow blocker and wherein at least one outboard flowing cooling channel includes at least one midflow blocker.

14. The turbine airfoil of claim 13, wherein a leading edge inboard flowing cooling channel includes at least one midflow blocker, at least two inboard flowing cooling channels and at least two outboard flowing cooling channels include at least one midflow blocker.

* * * * *